US010499789B2

(12) United States Patent
Gaus et al.

(10) Patent No.: US 10,499,789 B2
(45) Date of Patent: Dec. 10, 2019

(54) CLEANING DEVICE AND METHOD FOR CLEANING ARTICLES TO BE CLEANED

(71) Applicant: MEIKO Maschinenbau GmbH & Co. KG, Offenburg (DE)

(72) Inventors: Bruno Gaus, Offenburg (DE); Denis Lehmann, Ortenberg (DE); Thomas Näger, Offenburg (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 215 days.

(21) Appl. No.: 15/714,665

(22) Filed: Sep. 25, 2017

(65) Prior Publication Data

US 2018/0008121 A1 Jan. 11, 2018

Related U.S. Application Data

(63) Continuation of application No. PCT/EP2016/056364, filed on Mar. 23, 2016.

(30) Foreign Application Priority Data

Mar. 27, 2015 (DE) ..... 10 2015 205 602

(51) Int. Cl.
*A47L 15/00* (2006.01)
*A47L 15/42* (2006.01)

(52) U.S. Cl.
CPC ..... *A47L 15/4261* (2013.01); *A47L 15/0081* (2013.01); *A47L 15/4259* (2013.01)

(58) Field of Classification Search
CPC ..... A47L 15/0081
See application file for complete search history.

(56) References Cited

U.S. PATENT DOCUMENTS 2,480,865 A 9/1949 Lofstrand
3,582,173 A 6/1971 Noren et al.
4,073,555 A 2/1978 Noren
(Continued)

FOREIGN PATENT DOCUMENTS

DE 1879157 U 9/1963
DE 19931877 A1 1/2001
(Continued)

OTHER PUBLICATIONS

English Translation of International Search Report, PCT/EP2016/056364, dated Nov. 8, 2016, 3 pages.
(Continued)

*Primary Examiner* — Jason Y Ko
(74) *Attorney, Agent, or Firm* — Bose McKinney & Evans LLP

(57) ABSTRACT

A cleaning apparatus for cleaning articles for cleaning is proposed. The cleaning apparatus comprises at least one cleaning chamber and at least one covering apparatus which at least partially encloses the cleaning chamber. The covering apparatus is movable over an opening travel from a closed position into an opened position or vice versa. The covering apparatus is connected via at least one force transmission path to at least one spring element. At least one spring force of the spring element can be transmitted by means of the force transmission path to the covering apparatus. The force transmission path has at least one torque converter. The torque converter has a transmission ratio which varies over the opening travel.

16 Claims, 4 Drawing Sheets

(56) References Cited

U.S. PATENT DOCUMENTS

| | | | |
|---|---|---|---|
| 7,677,540 | B1 | 3/2010 | Duval |
| 2010/0243377 | A1 | 9/2010 | Duval |
| 2014/0260735 | A1 | 9/2014 | Roberts et al. |

FOREIGN PATENT DOCUMENTS

| | | | |
|---|---|---|---|
| DE | 10054392 | A1 | 5/2002 |
| EP | 1068833 | A2 | 1/2001 |
| EP | 1074686 | A2 | 2/2001 |
| EP | 1099403 | B1 | 6/2004 |
| EP | 2165636 | B1 | 11/2010 |
| EP | 1880654 | B1 | 5/2012 |
| EP | 1842477 | B1 | 10/2013 |
| FR | 1200736 | A | 12/1959 |
| FR | 2352527 | A1 | 12/1977 |
| FR | 2727302 | A1 | 5/1996 |
| JP | H01135065 | U | 9/1989 |
| JP | 2002291676 | A | 10/2002 |
| WO | WO 2010/133764 | A1 | 11/2010 |
| WO | WO 2013/109841 | A1 | 7/2013 |
| WO | WO 2013/109845 | A1 | 7/2013 |

OTHER PUBLICATIONS

English Translation of International Preliminary Report on Patentability, PCT/EP2016/056364, dated Sep. 28, 2017, 15 pages.

CLEANING DEVICE AND METHOD FOR CLEANING ARTICLES TO BE CLEANED

RELATED APPLICATIONS

This application is a continuation of PCT/EP2016/056364, filed Mar. 23, 2016, which claims priority to DE 10 2015 205 602.3, filed Mar. 27, 2015, the entire disclosures of which are incorporated herein by reference in their entireties.

BACKGROUND

This disclosure relates to a cleaning apparatus and to a method for cleaning articles for cleaning. Such cleaning apparatuses and methods may be used in particular in the field of dishwashing technology, in particular in the commercial field of large kitchens and communal catering. For example, this disclosure can be used for cleaning articles for cleaning in the form of articles for the preparation, serving, storage or accommodation of foods or beverages, such as for example crockery, cutlery, glasses, cups, pots, bowls or trays. In particular, this disclosure may be used in hood-type dishwashers or pass-through dishwashers. There, this disclosure offers the possibility in particular of weight compensation for the hood. Other fields of use are however also possible, for example fields of use in the cleaning of industrial articles, for example in the field of industrial production technology.

The prior art has disclosed numerous cleaning apparatuses and methods for cleaning different types of articles for cleaning. Without restriction of further possible usage possibilities, this disclosure will be described below with regard to dishwashing technology, that is to say with regard to cleaning apparatuses in the form of dishwashers. These may in particular be commercial dishwashers, wherein, below, again without restriction of further possible refinements, a description will be given in particular of pass-through dishwashers or hood-type dishwashers. Examples of such dishwashers are in particular the glass-washing and dishwashing machines of the DV series or the EcoStar series from Meiko Maschinenbau GmbH & Co. KG, Offenburg, Germany, or of the PT series from Winterhalter Deutschland GmbH, Meckenbeuren, Germany. This disclosure may however basically also be used in other products.

In known hood-type dishwashers, the hood is normally guided by means of a suitable guide, wherein the operating personnel can move the hood from a closed into an opened position or vice versa by means of corresponding handles and/or levers. Here, in general, a technical challenge consists in realizing weight compensation for the hood, such that the operating personnel at least do not have to fully bear the weight of the hood and such that the hood remains in the open state when desired.

U.S. Pat. No. 3,582,173 describes a dishwasher having a washing chamber and having a vertically movable door. Also described is a counterweight for the door, which counterweight holds the door in any position into which it is moved by hand.

DE 199 31 877 A1 has disclosed a lever mechanism for a spring-assisted actuation of a covering means of a dishwasher. Here, at least one lever mounted on a shaft is used, which lever is connected to a tension spring. Between the lever and the spring there is arranged a mechanical control means which yields an approximately constant lever arm between an articulation point and the shaft over a rotational angle of the shaft of up to approximately 100°.

EP 1 068 833 B1 has disclosed a handle for a liftable covering means. The handle is fastenable in a corner region of two mutually adjacent side surfaces of the covering means in a horizontal position. The handle has at least two engagement regions which are shaped such that the hand actuating the handle is, in terms of its position, oriented so as to be ergonomically aligned with the forearm. The handle furthermore has a relatively long first limb, which is oriented toward the front side, and a relatively short limb oriented toward the side surface, which limbs are connected via a substantially circular segment.

WO 2013/109841 A1 has disclosed a dishwasher having a hood which is mounted so as to be movable in vertically sliding fashion. The dishwasher furthermore has a handle which surrounds the hood at least on the front side and on at least one lateral side and which is mounted so as to be rotatable about a horizontal axis of rotation behind the hood. Here, spring means are connected between the handle and the housing in order to balance out the weight of the hood.

WO 2013/109845 A1 describes a dishwasher with a hood which is mounted in vertically sliding fashion and with a guide system for the hood. The guide system has a profile rail with a double-T-shaped profile.

EP 1 842 477 B1 has described a dishwasher which is designed to open and close a washing chamber which is provided on the side of a washer body. For this purpose, a door is moved upward and downward while a rotary arm which is arranged on a side surface of the door is rotated. The dishwasher furthermore comprises springs, the upper end of which is fastened to a base side of the rotary arm and the lower end of which is fastened to the side of the washer body. The dishwasher furthermore has a pair of left-hand and right-hand pillars which are provided on both corner parts on the rear side of the washer body. The left-hand and right-hand pillars are in the form of tubes, and the springs are accommodated in each case vertically in the pillars.

EP 1 880 654 B1 describes a dishwasher having a washing chamber which can be opened and closed. Here, a pivot arm arranged on a side surface of a door is pivoted. A rod is provided which runs in a vertical direction and which, at its upper end, is connected to a proximal end of the pivot arm. The dishwasher comprises a compression spring which runs in a vertical direction and which is arranged substantially parallel to the rod.

U.S. Pat. No. 4,073,555 has disclosed a dishwasher having a washing chamber and having a hood. Here, a door is provided which can be moved vertically from an upper position into a lower position. Furthermore, levers which are preloaded by means of springs are provided, which levers are connected to the door and balance out the door at any height between an open and a closed position.

EP 2 165 636 B1 has disclosed a commercial hood-type dishwasher having a hood which is mounted on at least two vertical guides. The hood slides along the guides with the aid of compensation springs which are suitable for limiting a force for opening or closing the hood. The at least two guides are telescopic guides and comprise slidingly mounted parts, to which the hood is fastened and the movement of which is driven by cables. The movement of the sliding parts is driven by cables which are acted on by the compensation springs via movable rollers, the latter being arranged on panels which are mounted pivotably on the dishwasher structure.

DE 100 54 392 A1 has disclosed a drive apparatus for automatically moving a hood which is rotatably mounted and vertically movable on a body of a dishwasher. Here, a traction means is driven by means of a tensioning and/or tension-relieving apparatus.

EP 1 099 403 B1 has disclosed an apparatus for opening a cover of a dishwasher. The cover is movable vertically from a closed position into an open position and vice versa with the aid of a handle device. The handle device can be actuated by hand and is connected to a movable element of a fluid-dynamic actuation unit. The apparatus furthermore has an elastic restoring device which is connected to the movable element in order to move the actuation unit automatically into an inactive position when the cover is in the open position.

The cleaning apparatuses known from the prior art, however, have numerous disadvantages or technical challenges in practice. One challenge consists for example in that the hood generally has to be moved over a large travel distance. For example, a situation may arise in which a particular usage situation necessitates a greater pass-through height for the introduction of articles for cleaning. In this case, cam control by means of a hood bracket for the compensation of different forces becomes increasingly more difficult. In the case of large lifting heights, it is furthermore the case that an engagement point at which the operating personnel act on the hood bracket is generally situated at an ergonomically adverse height.

In many cases, a further technical challenge lies in the fact that a large movement travel can no longer be realized by means of a guide within a washing chamber. Furthermore, guides arranged within a washing chamber tend to become fouled, with a tendency for the free movement of the guide to deteriorate over the service life.

A further technical challenge lies in the weight compensation, known from the above-cited prior art, by means of a counterweight. Such a counterweight can considerably increase the overall weight of a dishwasher. Furthermore, in the case of a closed hood, the counterweight may be lifted into the upper region of the dishwasher. During transport, however, this top-heaviness of the dishwasher is in many cases highly disruptive. Furthermore, during installation, the counterweight must be maneuvered to the corresponding height by the installation personnel, which in many cases necessitates the use of several installation persons. A further challenge lies in the fact that, during a movement of the hood, not only the mass of the hood but also the mass of the counterweight must be accelerated. In the case of a manually operated hood, this necessitates increased expenditure of force by the operating personnel. By contrast, in the case of an automatically driven hood, a drive must be designed to be more powerful.

A further technical challenge is that safety aspects must be taken into consideration during the opening and closing movement of the hood. For example, if cables are used in a mechanism for weight compensation, such cables must be regarded as particularly critical from safety aspects. In practice, cables constitute wearing parts and, in particular, exhibit a tendency for sudden failure. Safeguards against this are generally necessary.

SUMMARY

This disclosure teaches a cleaning apparatus and a method for cleaning articles for cleaning, which at least substantially avoids the disadvantages of known apparatuses and methods. In particular, freely moving, permanent operation of a covering apparatus of the cleaning apparatus is permitted and is reliably effective over the entire opening travel path of said covering apparatus. At the same time, high safety requirements are satisfied.

Below, the expressions "exhibit," "have," "comprise" or "include" or any grammatical variants thereof are used in a non-exclusive manner. Accordingly, such expressions may refer both to situations in which no further features are provided in addition to the features introduced by such expressions, or to situations in which one or more further features are provided. For example, the expression "A exhibits B," "A has B," "A comprises B" or "A includes B" may refer both to the situation in which no further element aside from B is provided in A (that is to say to a situation in which A is composed exclusively of B) and to the situation in which, in addition to B, one or more further elements are provided in A, for example element C, elements C and D, or even further elements.

It is furthermore pointed out that the expressions "at least one" and "one or more" and grammatical variants of such expressions, where used in conjunction with one or more elements or features and intended to express that the element or feature may be provided singly or multiply, are generally used only once, for example when the feature or element is introduced for the first time. When the feature or element is mentioned again later, the corresponding expression "at least one" or "one or more" will generally no longer be used, without restriction of the possibility that the feature or element may be provided singly or multiply. Thus, it shall be understood that various structural terms used throughout this disclosure and claims should not receive a singular interpretation unless it is made explicit herein. By way of non-limiting example, the terms "spring element," "traction member," and "force transmission path," to name only a few, should be interpreted when appearing in this disclosure and claims to mean "one or more" or "at least one." All other terms used herein should be similarly interpreted unless it is made explicit that a singular interpretation is intended. As noted above, while this disclosure uses the terms "at least one" in several instances throughout, when a structural or functional feature is listed in the specification or claims without being preceded by "at least one," said feature shall still be interpreted as meaning "at least one" or "one or more."

Furthermore, below, the expressions "preferably," "in particular," "for example" or similar expressions will be used in conjunction with optional features, without alternative embodiments hereby being restricted. Accordingly, features introduced by such expressions are optional features, and it is not intended to restrict the scope of protection of the claims, and in particular of the independent claims, by means of such features. Accordingly, as a person skilled in the art will identify, the invention may also be implemented using other refinements. Similarly, features introduced by "in one embodiment of the invention" or "in one exemplary embodiment of the invention" are to be understood to be optional features, without this being intended to restrict alternative refinements or the scope of protection of the independent claims. Furthermore, it is the intention that all possibilities of combining the features hereby introduced with other features, whether these be optional or non-optional features, remain unaffected by such introductory expressions.

In a first aspect of this disclosure, a cleaning apparatus for cleaning articles for cleaning is proposed. A cleaning apparatus is generally to be understood in the context of this disclosure to mean an apparatus in which the articles for cleaning are cleaned by means of at least one cleaning fluid in order to at least partially remove adherent dirt and/or other contaminants from said articles. The cleaning fluid may in particular comprise at least one cleaning liquid. Furthermore, the cleaning apparatus may also exert a germ-killing action or even a disinfecting action on the articles for cleaning. Accordingly, a method for cleaning articles for cleaning, as proposed in a second aspect of this disclosure, hereinafter also referred to as cleaning method, is to be understood to mean an application of at least one cleaning fluid to the articles for cleaning for the purposes of at least partially removing adherent dirt from the articles for cleaning.

Here, articles for cleaning may be understood generally to mean any goods which can be subjected to cleaning or a cleaning process, for example industrial goods. Without restriction of further possible refinements, reference will hereinafter be made to articles for cleaning in the form of articles for washing and/or crockery. Articles for washing are intended here to encompass basically any articles which are used for the preparation, storage, serving or transportation of foods and/or beverages. In particular, articles for washing referred to here may be selected from the group comprising crockery, such as cups, plates, glasses, dishes or bowls; pots; trays; cutlery; warming apparatuses; containers; boxes; baskets. Other apparatuses that can be used directly or indirectly for the storage, preparation, transport or serving of foods and/or beverages or precursors of foods and/or beverages may also be used. The cleaning apparatus may thus be designed in particular as a dishwasher and particularly preferably as a hood-type dishwasher and/or as a pass-through dishwasher.

The cleaning apparatus furthermore comprises at least one cleaning chamber and at least one covering apparatus which at least partially encloses the cleaning chamber. A cleaning chamber may be understood generally to mean a space which is entirely or at least partially shielded and in which at least one cleaning fluid and/or multiple cleaning fluids can be applied to the articles for cleaning. Accordingly, for example, at least one application device for applying the at least one cleaning fluid to the articles for cleaning may be provided within the cleaning chamber. Furthermore, complete or partial drying of the articles for cleaning may also be performed within the cleaning chamber. The cleaning apparatus may in particular be designed as a single-chamber cleaning apparatus. The articles for cleaning may hereinafter also be referred to as articles for washing, and the cleaning chamber may also be referred to as washing chamber.

As stated above, the cleaning apparatus has at least one covering apparatus which at least partially encloses the cleaning chamber. A covering apparatus is to be understood here generally to mean an apparatus or an element which at least partially delimits the cleaning chamber and simultaneously allows access to the cleaning chamber, for example for the feed of articles for cleaning into the cleaning chamber or for the removal of the articles for cleaning from the cleaning chamber. The covering apparatus may thus in particular form a chamber wall of the cleaning chamber or a part of a chamber wall of the cleaning chamber. In particular, as discussed in more detail below, the covering apparatus may be designed entirely or partially as a hood and/or casing, which is mounted so as to be displaceable in a vertical direction. For example, the covering apparatus may comprise a hood which can be displaced upward in order to open the cleaning chamber and which can be displaced downward in order, for example together with a base of the cleaning apparatus, to close the cleaning chamber.

The covering apparatus is movable over an opening travel from a closed position into an opened position or vice versa. The covering apparatus is thus generally mounted so as to be movable such that it can be moved into at least two different positions, specifically into an opened position and a closed position. The multiplicity of possible positions between the opened position and the closed position, optionally including the opened position and the closed position, is referred to as opening travel. In particular, the covering apparatus may be mounted so as to be movable manually, for example by a user. Alternatively or in addition, it is however also possible for an automatic movement to be provided, for example by means of a motor described in more detail below.

The covering apparatus is connected via at least one force transmission path to at least one spring element. Here, a force transmission path is to be understood generally to mean an element or a multiplicity of interacting elements, by means of which at least one force can be transmitted from a first region, for example a force generator, to at least one second region, for example a force transducer. Here, the forces may be transmitted in basically any form, wherein mechanical forces, in particular a transmission by means of tensile forces, compressive forces, torques and other types of mechanical force transmission, are however generally preferred.

In the context of this disclosure, a spring element is to be understood generally to mean an element which is designed to absorb and/or release elastic energy. In particular, the spring element may have at least one elastically deformable element. As described in more detail further below, the spring element may in particular comprise at least one helical spring or spiral spring. Other spring elements are basically also possible. The spring element may in particular have at least one energy store in which mechanical energy can be stored in the form of an elastic deformation. The at least one spring element may for example be connected at one end directly or indirectly to the cleaning apparatus, for example to a base of the cleaning apparatus, in particular to a frame of the cleaning apparatus, wherein the base for example remains positionally fixed during a movement of the covering apparatus. The spring element may be connected by means of at least one other end via the force transmission path to the covering apparatus. In particular, the spring element may be designed so as to be relieved of stress during the movement of the covering apparatus from the closed position into the opened position and to be placed under stress, for example expanded, during a movement in the opposite direction. A reverse action of the spring element is however basically also possible.

At least one spring force of the spring element is transmitted by means of the force transmission path to the covering apparatus. For example, said spring force may be configured so as to counteract a weight force of the covering apparatus, in particular in the case of covering apparatuses in which the opened position is arranged above the closed position and in which the covering apparatus thus has greater potential energy or positional energy in the opened position than in the closed position. This may be the case for example in hood-type dishwashers or pass-through dishwashers in which a hood or a hood casing is displaced upward in order to open the cleaning chamber. In such dishwashers, the spring force may for example counteract the weight force.

The force transmission path has at least one torque converter. Here, a torque converter is to be understood generally to mean an element by means of which a torque can be transmitted, by means of which a torque can be converted into a force, by means of which a force can be converted into a torque, by means of which a torque can be converted into a force and subsequently back into a torque or by means of which a force can be converted into a torque and subsequently back into a force. The torque converter may thus generally be a mechanical-mechanical converter, in which case one or more torques are converted into one or more further torques and/or into one or more forces. In particular, the torque converter may have at least one mechanism, for example at least one mechanism selected from the group comprising a chain mechanism, a toothed-wheel mechanism or a friction-wheel mechanism.

The torque converter has a transmission ratio which varies over the opening travel path. Here, a transmission ratio is to be understood generally to mean a ratio between a drive-input rotational speed and a drive-output rotational speed. For example, a first torque may be applied to the torque converter and be converted into a second torque, wherein the ratio between the first torque and the second torque, or the reciprocal thereof, can be referred to as transmission ratio. A transmission ratio which varies over the opening travel is to be understood here generally to mean that the torque converter has a first transmission ratio at at least one first point or in at least one first range of the opening travel of the covering apparatus and has a second transmission ratio at at least one second point or in at least one second range of the opening travel, wherein the first transmission ratio and the second transmission ratio differ from one another. It is thus possible, for example, for the transmission ratio to change in continuous fashion over at least one range of the opening travel. It is however alternatively or additionally also possible for one or more ranges to be provided in which a stepped change in the transmission ratio occurs. Examples will be discussed in more detail below.

Several of the above-described problems can be solved by means of the transmission ratio which varies over the opening travel. In particular, the problem that the spring force of the at least one spring element may be dependent on a state of expansion of the spring element can be counteracted. In this regard, reference may be made for example to Hooke's law. Through the use of a torque converter with varying transmission ratio, it is possible to realize a homogenization of the spring force transmitted from the spring element to the covering apparatus at the location of the covering apparatus, such that, for example, over the opening travel, for example with the exception of the closed position, an at least approximately constant force is transmitted to the covering apparatus, which force may for example be equal to the weight force of the covering apparatus at all points of the opening travel, for example with the exception of the closed position. In this way, it can for example be ensured that the covering apparatus is in force equilibrium at all points of the opening travel.

As stated above, the cleaning apparatus may be, in particular, a dishwasher. The dishwasher may in particular be selected from a hood-type dishwasher and a pass-through dishwasher. A hood-type dishwasher is to be understood here generally to mean a dishwasher which has a base, which provides a bottom side of the washing chamber, and at least one hood or one hood casing as a covering apparatus, which entirely or partially form at least one side wall of the cleaning chamber and optionally at least one cover of the cleaning chamber and which can be moved open in an upward or downward direction in order to open up the cleaning chamber. A pass-through dishwasher is to be understood generally to mean a dishwasher which has at least one pass-through apparatus by means of which articles for cleaning, for example a basket with articles for cleaning, can be pushed into the washing chamber from a push-in side, for example when a hood is open, and in which, on a second side, for example a removal side, the articles for cleaning can be pushed out of the cleaning chamber again after a cleaning process has been performed. In practical linguistic usage, the expression "pass-through dishwasher" is often also used as an all-encompassing term and also encompasses, for example, hood-type dishwashers with a pass-through apparatus and dishwashers in which only lateral walls can be moved in order to open the washing space. Pass-through dishwashers generally comprise no active pass-through apparatus, but instead involve crockery being passed through manually. The pass-through apparatus comprises, for example, slide rails and/or guides. For examples of such hood-type dishwashers, reference may be made to the prior art cited above.

As stated above, the covering apparatus (also referred to herein as "cover") may be configured in a variety of ways. In particular, the covering apparatus may be selected from the group comprising: a hood which at least partially covers and/or encloses the cleaning chamber; a casing which at least partially encloses the cleaning chamber; a sliding door. Other refinements of the covering apparatus are basically also possible. In particular, the covering apparatus may also be designed entirely or partially as a door, as a slide or as a flap. Below, a description will be given of the preferred refinement in which the covering apparatus is designed entirely or partially as a hood and/or as a casing. For example, the hood and/or the casing can be moved open in an upward or downward direction.

The opening travel may at least partially have a vertical direction component. It is thus generally possible for the at least one covering apparatus to move preferably in a vertical direction upward, in particular during the opening of the covering apparatus, and/or downward, in particular during the closing of the covering apparatus. Such a refinement of a vertical or at least partially vertical opening travel can be realized in particular in hood-type dishwashers and/or in pass-through dishwashers.

As stated above, the covering apparatus may in particular have different potential energy, in particular different positional energy, in the closed position and in the opened position. For example, in the opened position, the covering apparatus may be arranged at least partially above the closed position, such that, in particular, the covering apparatus has greater potential energy in the opened position than in the closed position. This refinement can also be realized in particular in hood-type dishwashers or in pass-through dishwashers.

As described above, the cleaning apparatus may in particular furthermore have at least one application apparatus for applying at least one cleaning fluid to the articles for cleaning in the cleaning chamber. For example, in the cleaning chamber, there may be provided one or more cleaning nozzles via which the cleaning fluid can be sprayed and/or dripped onto the articles for cleaning. In particular, one more spray arms, in particular rotating spray arms, may also be provided.

The cleaning apparatus may in particular be designed as a commercial cleaning apparatus, in particular as a commercial dishwasher. Commercial dishwashers are generally distinguished from domestic appliances in that separate systems are provided for a washing process and for a rinsing process. This means in particular that, already during the washing process, a rinsing liquid can be prepared in a separate rinsing system, for example by means of corresponding temperature control and/or corresponding addition of additives such as for example a clear-rinsing agent. Accordingly, the cleaning apparatus may in particular have at least one preparation tank which is formed separately from the cleaning chamber, in particular at least one boiler, wherein temperature control of a rinsing liquid can be performed in the preparation tank while a washing process is already taking place in the cleaning chamber. After the completion of the washing process, it is then for example possible to switch to a rinsing process, wherein washing liquid can be pumped out, or can flow out, of the washing chamber before the rinsing process is then performed using the previously prepared rinsing liquid. The at least one rinsing process may then be followed, for example, by at least one drying process.

Further possible details relate to the force transmission path. The force transmission path may in particular have at least one mechanism. A mechanism may be understood generally to mean a machine element by means of which movement parameters can be changed. For example, a change in a force or in a torque may be realized by means of the mechanism. In particular, a movement to be changed may be a rotational movement. The torque converter may in particular be a constituent part of the mechanism.

The mechanism may in particular comprise at least one traction means mechanism or traction drive, in particular at least one chain mechanism or chain drive. Here, a traction means mechanism (or traction drive) is to be understood generally to mean a mechanism in which a torque is transmitted between two elements, for example between at least one shaft and at least one further element, in particular also between two shafts, with the aid of a traction means (or traction member), for example a traction member which loops around the at least one shaft. A traction means (or traction member) may be understood generally to mean a deformable, for example flexible or expandable elongate element by means of which a tensile force can be transmitted. For example, the force transmission path may have at least one traction means, in particular a flexible traction means. The traction means may in particular be selected from the group comprising: a chain, in particular a roller chain, a bolt chain or a link chain; a cable and/or cable pull; an elastic band; a belt, in particular a toothed belt or a V-belt. Other traction means may however basically also be used.

In particular, the transmission path may be configured such that the at least one traction means is of redundant configuration. For example, for the transmission of a tensile force from one element to another element, a multiplicity of traction means may be provided which may for example be of identical design. It is thus possible, for example, to prevent or minimize faults which could arise as a result of a breakage or some other form of damage to or malfunction of the traction means.

The torque converter may in particular have at least one torque-transmitting element which is mounted so as to be rotatable about at least one axis. For example, at least one traction means may engage on the torque-transmitting element at at least one engagement region or engagement point which are spaced apart from the axis by at least a spacing R, and said traction means may exert a torque on the torque-transmitting element. The spacing R may be dependent on an angular position of the torque-transmitting element, for example an angular position in any desired coordinate system, for example a polar coordinate system with the axis of the torque-transmitting element as coordinate axis. In particular, the spacing R may change over at least one angle range, wherein the change may for example be selected from the group comprising: a continuous change; a steady change, for example a steady decrease or a steady increase; a stepped change. Examples will be discussed in more detail below.

The torque converter may in particular have at least one chain disc with at least a variable radius. The chain disc may for example be designed so as to have a different radius in at least one first angle range than in at least one other angle range.

The covering apparatus may in particular be connected via at least one first traction means to a shaft. Said connection may be direct or indirect. Said first traction means may connect the covering apparatus to the shaft directly or via one or more diverting rollers. In this way, a rotational movement of the shaft can be transmitted or converted into an opening or closing movement of the covering apparatus. Alternatively or in addition, it is conversely also possible for an opening or closing movement of the covering apparatus to be transmitted or converted into a rotational movement of the shaft. The shaft may in particular be connected via at least one second traction means to the spring element. In this case, too, the connection may be direct or indirect, for example also again with the interposition of one or more intermediate elements. In turn, it is also possible for a diversion to be realized by means of one or more diverting rollers. The at least one torque converter with the varying transmission ratio may be arranged between the first traction means and the shaft and/or between the shaft and the second traction means. For example, the first traction means may engage on the shaft via at least one first chain disc, and the second traction means may engage on the shaft via the chain disc with the variable radius. Here, the chain disc via which the first traction means engages on the shaft may for example be a chain disc with constant radius. A design with variable radius is however alternatively also possible. It is however alternatively also possible for the first traction means to engage on the shaft via a chain disc with variable radius and for the second traction means to engage on the shaft via a chain disc with a constant radius. Various refinements are possible for obtaining a variable transmission ratio over the opening travel.

The spring element may in particular have different states of expansion in at least two different positions of the covering apparatus along the opening travel. The torque converter may be designed such that different spring forces of the spring element resulting from the different states of expansion are compensated by means of the different transmission ratios, such that at least substantially identical forces act on the covering apparatus in the different positions. Here, "at least substantially identical" forces are to be understood generally to mean identical forces or forces which differ from one another for example by no more than 20%, preferably by no more than 10% and particularly preferably by no more than 5%. Since the spring forces of the spring element are generally known as a function of the deflection of the spring element (for example by applying empirical measurement methods or else by applying Hooke's law), the transmission ratio can be easily calculated such that identical forces or at least substantially identical forces act on the covering apparatus in the two different positions, and preferably over the entire opening travel, for example with the exception of the closed position.

The spring element, the covering apparatus and the torque converter with its varying transmission ratio may in particular be configured such that, in the absence of action of additional forces, the covering apparatus remains at rest in any position of the opening travel. Here, "additional forces"

are to be understood generally to mean any forces which are not exerted by the weight force of the components involved and/or by the spring force of the at least one spring element on the covering apparatus, on the torque converter and on the spring element. In particular, such forces may be forces applied manually by an operating person and/or forces introduced by at least one additional motor. In the preferred refinement, however, the covering apparatus should remain at rest in any position of the opening travel in the absence of such additional forces.

As stated above, one or more traction means may be of redundant configuration. It is alternatively or additionally also possible for the at least one spring element to be of redundant configuration, such that at least two spring elements may be provided. In particular, the at least one spring element may comprise at least two identical spring elements. Owing to the redundancy, it is for example possible for faults which can arise as a result of a breakage of a spring element to be at least partially reduced in terms of their effect.

The spring element may in particular furthermore have at least one safety element, wherein the safety element may be designed to catch a breakage of the spring element or, if multiple spring elements are provided, of at least one of the spring elements. Here, a safety element is to be understood generally to mean any element which has the stated safety function. In particular, the safety element may be a mechanical element which impedes or prevents a further movement of one or more elements within the force transmission path as soon as one spring element has broken. It is thus possible, in the event of a breakage of a spring element, for a further movement of a redundant further spring element to be reduced or prevented, for example a movement of a second spring element in the form of a further expansion of said second spring element. The safety element may be realized in particular by means of at least one safety rod, as discussed in more detail further below. Thus, it is for example possible for at least one safety rod to be provided, wherein, in the event of a breakage of the spring element, the force transmission path couples to the safety rod, such that, for example, a free movement of the force transmission path is prevented owing to a breakage of the spring element.

The coupling may for example be realized by virtue of a transmission element becoming jammed between the force transmission path and the safety rod as soon as a breakage of the spring element occurs. By means of said jamming, a fixed coupling can be realized, whereas in a normal state in which the spring element is not broken, the safety rod is for example mounted in sliding fashion relative to the transmission element. The transmission element may for example comprise at least one balance beam through which the safety rod extends. For example, two spring elements may engage on two mutually oppositely situated ends of the balance beam, wherein the balance beam has, in the center, a passage bore in which a safety rod is mounted. The balance beam can be held in equilibrium by means of the two spring elements such that, in a normal state, the safety rod is not jammed relative to the balance beam. By contrast, if one of the spring elements breaks, then the spring force of the remaining spring element causes the balance beam to tilt relative to the safety rod and to be jammed against the safety rod, such that the balance beam can fixedly couple to the safety rod. The force transmission path, for example at least one traction means of the force transmission path, may be coupled to the balance beam, such that in the event of the jamming of the balance beam, coupling of the force transmission path, in particular of the traction means, to the balance beam can occur. Other types of safety elements are however basically also possible.

The covering apparatus may in particular furthermore have at least one actuation element which is actuable by a user of the cleaning apparatus in order to exert a force on the covering apparatus and thereby move the covering apparatus from the closed position into the opened position or vice versa. The at least one actuation element may be mounted directly on the covering apparatus and/or may be entirely or partially integrated therein. The actuation element may in particular have at least one handle which may for example be connected to the cover or which may be integrated entirely or partially into the cover. The design and form of the handle is, in principle, arbitrary. A form which permits ergonomic actuation by the operating personnel is preferred. The actuation element may alternatively engage indirectly on the covering apparatus.

Further possible refinements relate to the spring element. Accordingly, the spring element may in particular be a helical spring; a spiral spring; a torsion spring; a leaf spring; an elastic element, in particular an elastic band. Other refinements are however alternatively or additionally possible. Furthermore, it is also possible for different types of spring elements to be combined with one another.

The spring element may in particular be expanded to a maximum extent in the closed position of the covering apparatus. This may mean in particular that the spring element has a first extent in the opened position and a second extent in the closed position, wherein the second extent is greater than the first extent and wherein no extent greater than that in the closed position arises in an intermediate region along the opening travel between the closed position and the opened position.

In addition to the abovementioned force action of the spring force of the spring element, the cleaning apparatus may have at least one electromechanical drive for moving the covering apparatus. In particular, the electromechanical drive may have at least one motor. The electromechanical drive may be selectively couplable to the covering apparatus. The electromechanical drive can thus be coupled, preferably selectively, to the force transmission path, for example. For example, the electromechanical drive may be coupled or couplable to the abovementioned shaft to which the first traction means, the second traction means and the torque converter with the varying transmission ratio can also be coupled. For example, it is also possible for a rotational movement which is transmitted by the electromechanical drive, for example the motor, to the shaft to be transmitted in the form of a force to the covering apparatus, for example in order to open the covering apparatus.

The cleaning apparatus may alternatively or additionally also be equipped with some other type of drive for the covering apparatus. For example, at least one drive may be provided which is selected from the group comprising a hydraulic drive, an electrohydraulic drive, a pneumatic drive or an electropneumatic drive. Other embodiments are however also conceivable.

The cleaning apparatus may furthermore have at least one torque monitoring means for monitoring a torque exerted by the electromechanical drive on the covering apparatus. Here, the torque may be detected directly at the covering apparatus, directly at the and/or in the drive or at any desired element between the electromechanical drive and the covering apparatus, for example within the force transmission path. A combination of the stated possibilities is also conceivable. The force transmission path may also be utilized entirely or partially for transmitting a force from the electromechanical drive to the covering apparatus. The torque monitoring means may for example be designed such that, when a maximum torque, for example a predefined limit torque, arises, the drive is automatically stopped, deactivated or decoupled. The torque monitoring means may thus be selected for example from the group comprising a torque support; a switch, in particular a torque switch and/or a limit switch; a torque sensor; a freewheel; a ratchet wheel. Numerous other refinements of a torque monitoring means are possible.

The cleaning apparatus may furthermore have at least one controller. This may for example be a central machine controller by means of which one or more washing programs can be controlled. For example, the controller may be set up to control at least one washing process, at least one rinsing process and optionally at least one drying process. The controller may also be set up to detect a movement and/or a position of the covering apparatus. Said detection may be realized for example by means of a detection of a position and/or of a movement of the transmission path. Such monitoring may also be performed at other locations. For example, the cleaning apparatus and in particular the controller may be set up to monitor forces and/or torques within the force transmission path.

The cleaning apparatus may furthermore have at least one guide element, wherein the guide element may be set up to guide the covering apparatus over the opening travel. Said guide element may in particular involve a vertically oriented guide. The guide element may in particular have at least one guide rail. For example, two guide rails may be provided outside a hood. Other refinements are also possible. The at least one guide element may in particular be arranged entirely or partially outside the cleaning chamber.

As stated above, in a second aspect of this disclosure, a method for cleaning articles for cleaning is proposed. The method may in particular be performed using the cleaning apparatus according to this disclosure, in particular according to one or more of the refinements described above and/or according to one or more of the refinements described in more detail below. Accordingly, for possible definitions and/or options of the method, reference may be made to the description of the cleaning apparatus.

The method comprises various method steps which may for example be performed in the stated sequence. A different sequence is however basically also possible. Furthermore, the method may comprise additional method steps which are not mentioned. Furthermore, it is also possible for one or more or else all of the method steps to be performed repeatedly and/or continuously. Furthermore, two or more of the stated method steps, or else all of the stated method steps, may also be performed at the same time or in an overlapping manner in terms of time.

The method comprises at least one cleaning step in which cleaning of the articles for cleaning is performed in at least one cleaning chamber. For example, said cleaning step may comprise at least one washing step and/or at least one rinsing step or clear-rinsing step. Furthermore, said at least one cleaning step may also optionally comprise at least one drying step.

Furthermore, in the method, at least one covering apparatus which at least partially encloses the cleaning chamber is used. The method furthermore comprises an opening step and/or a closing step, wherein a movement of the covering apparatus is performed over an opening travel from a closed position into an opened position or vice versa.

The covering apparatus is connected via at least one force transmission path to at least one spring element. The method comprises at least a transmission of at least one spring force of the spring element by means of the force transmission path to the covering apparatus. The force transmission path has at least one torque converter, wherein the torque converter has a transmission ratio which varies over the opening travel.

For further possible refinements of the method, reference may be made to the above description of the cleaning apparatus or also to the following exemplary embodiments.

The proposed cleaning apparatus and the proposed method have numerous advantages in relation to known apparatuses and methods and can be advantageously implemented in particular in hood-type dishwashers and pass-through dishwashers.

For example, a guide of the covering apparatus, in particular of the hood, outside the washing space is possible, for example on a rear side of a machine housing. The guide may be realized for example by means of two guide elements in the form of rectangular profiles on the right and on the left on the machine, for example with rectangular tubes or square tubes. The guide may for example be arranged vertically and may be supported for example by in each case three rollers. Other embodiments of the guide are also possible. For example, on the guide profiles, in each case one cantilever arm may be formed in a forward direction at the top, onto which cantilever arm the fully preassembled hood can be pushed and secured using only a small number of fastening elements, for example two bolts. In this way, a guide which is particularly easy to assemble can be realized.

In each case at least one traction means, for example in each case at least one roller chain, can be fastened to each guide, for example to each guide profile, at the bottom. The at least one traction means may for example be guided over in each case at least one diverting wheel in the upper region of the machine housing and may for example furthermore be laid onto in each case one sprocket in the lower region of the housing. In general, each traction means may be tensioned without a diversion or may exhibit one or several diversions.

The two traction means, for example the roller chains, connected to the guide profiles may for example be connected at their lower end to in each case one sprocket or chain disc. Said two lower sprockets are for example connected rotationally conjointly to one another, for example by means of the abovementioned shaft. Furthermore, the two lower sprockets may additionally be assigned a third chain disc or sprocket, for example by virtue of said third chain disc or sprocket being mounted rotationally conjointly on the shaft. Said third sprocket may for example be the torque-transmitting element with the radius which is dependent on the angular position. A further chain may be laid onto said third sprocket in the opposite direction to the other chains, which further chain may be connected at the other end to the at least one spring element, for example to one or preferably multiple tension springs. The at least one spring element, for example the tension springs, may for example be fastened in the upper part of the housing.

If the covering apparatus, for example the hood, is closed, the two chains which are fastened at the bottom to the guide profiles may be substantially unwound from their wheels. By contrast, the third chain may be substantially wound onto its wheel, and the tension springs may be in a stressed state. During the lifting of the covering apparatus out of the closed position, for example during the lifting of the hood, the first two chains can wind up on their wheels. At the same time, the third chain can be unwound, and the at least one spring element, for example the tension springs, can be relieved of stress.

To compensate for the change in the spring force over the travel, the third wheel preferably exhibits, as stated above, an effective radius and/or pitch circle which varies over the circumference. In this way, a torque converter with a varying transmission ratio can be realized in a particularly simple manner. The third sprocket or chain disc, which is connected via the at least one third traction means to the at least one spring element, can thus act as a torque-transmitting element, with a spacing between an axis of rotation and an engagement point of the third traction means which is dependent on the angular position. Here, an engagement point is to be understood generally to mean a circumferential point at which a tangential or at least not fully radial force is exerted on the torque-transmitting element. This may for example be the point at which the third traction means lifts off from a circumference of the torque-transmitting element.

By means of this embodiment, it is for example possible for the variation of the spring force over the travel and/or versus the expansion of the at least one spring element to be adapted to the force actually required for the compensation of the weight of the hood. In addition to a uniform and/or continuous decrease in radius or increase in radius of the at least one optional torque at transmitting element, it is also possible to realize non-uniform adaptations. For the damping of the movement at the end positions, it is alternatively or additionally also possible, for example, for step-like changes in diameter to be incorporated on the sprockets.

The sprockets may for example be manufactured from metal individually and assembled. Furthermore, individual parts of the wheel set, such as for example guide discs, or else the entire wheel set, may be manufactured entirely or partially from plastic. For example, the entire mechanism may be produced entirely or partially from metal and/or plastic. Use may also be made of other materials, such as for example ceramic materials.

The wheel set may for example be mounted by means of rolling bearings, which permits low friction and thus smooth running.

To realize a machine design of the cleaning apparatus with semiautomatic or fully automatic covering apparatus, for example a hood, it is possible for an electric motor and/or some other type of electromechanical drive to be coupled to the mechanism, for example to the wheel set. The coupling to the mechanism may for example likewise be realized by at least one traction means, for example by means of at least one further chain and two pinions.

Furthermore, in the context of the proposed cleaning apparatus, safety measures can be realized in a simple manner. For example, in order to protect operating personnel against excessively high closing forces of the automated covering apparatus, in particular the hood, one or more of the following safety measures may be implemented.

For example, the electromechanical drive, in particular the electric motor, may be fastened such that its torque is absorbed via a torque support, for example a spring-supported torque support. In the presence of an excessively high torque, for example proceeding from a limit value or in the event of exceedance of a limit value, corresponding for example to a limit value for a closing force on the covering apparatus, in particular the hood, said torque support is deflected. Said movement may be detected for example by means of a switch, which transmits its signal to the controller. The controller may then for example end the movement of the covering apparatus, in particular of the hood, and initiate a reversed movement.

It is alternatively or additionally possible for a rotary encoder to be integrated for example in the drive train, which rotary encoder is connected to the controller. The controller can identify an absence of the signals from the rotary encoder, for example owing to the movement being impeded. In this case, the controller can then end the movement of the covering apparatus, in particular of the hood, and/or initiate other actions, for example a reversed movement.

To limit a pinching force that may arise, the weight compensation force for the covering apparatus, in particular the hood, may be coordinated with the closing force by the drive such that safe values are not exceeded.

For compensation of the weight of the covering apparatus, in particular of the hood, various concepts may be implemented in the cleaning apparatus. For example, in particular for a manual actuation of the covering apparatus, it may be provided that, over the entire opening travel, which may also be referred to as movement travel, or over at least a part thereof, the weight of the covering apparatus, in particular of the hood, may be 100% compensated by the spring force acting on the covering apparatus and converted by the force transmission path. Here, tolerances may also be acceptable, as stated above, for example tolerances of no more than 10%, in particular no more than 5% or even no more than 2%. Deviations from said 100 percent compensation may optionally be provided only in one or more particular positions along the opening travel. For example, in the closed position, the weight force of the covering apparatus, in particular of the hood, in its lower, closed position may be compensated only incompletely, such that the covering apparatus or hood remains securely closed during operation of the cleaning apparatus. Alternatively or in addition, locking may self-evidently also be realized in said closed position.

A semiautomatic actuation of the covering apparatus may alternatively or additionally also be performed, in particular a semiautomatic hood actuation. In particular, in this case, over the entire opening travel or at least over a part of said opening travel, the weight compensation is preferably set such that the covering apparatus, in particular the hood, moves automatically into the opened position. Then, for the operation of the cleaning apparatus, it is generally necessary for the operating personnel to move the covering apparatus, for example the hood, into the closed position, in particular the lower position, by hand. There, the covering apparatus can be automatically fixed and/or locked, for example by means of at least one locking mechanism which can be actuated for example by the controller. At the end of a washing cycle, the controller may for example unlock the locking mechanism again, and the covering apparatus may then for example open automatically or be openable.

It is in turn alternatively or additionally possible for a fully automatic actuation of the covering apparatus to be realized. In particular, in this case, the weight of the covering apparatus, in particular of the hood, may be 100% compensated over the entire opening travel or over at least a part thereof. A drive mechanism can move the covering apparatus, for example in a manner controlled by corresponding commands from the controller.

In summary, in the context of this disclosure, the following embodiments are particularly preferred:

Embodiment 1: Cleaning apparatus for cleaning articles for cleaning, comprising at least one cleaning chamber and at least one covering apparatus which at least partially encloses the cleaning chamber, wherein the covering apparatus is movable over an opening travel from a closed position into an opened position or vice versa, wherein the covering apparatus is connected via at least one force transmission path to at least one spring element, wherein at least one spring force of the spring element can be transmitted by means of the force transmission path to the covering apparatus, wherein the force transmission path has at least one torque converter, wherein the torque converter has a transmission ratio which varies over the opening travel.

Embodiment 2: Cleaning apparatus according to the preceding embodiment, wherein the cleaning apparatus is a dishwasher.

Embodiment 3: Cleaning apparatus according to the preceding embodiment, wherein the dishwasher is selected from a hood-type dishwasher and a pass-through dishwasher.

Embodiment 4: Cleaning apparatus according to one of the preceding embodiments, wherein the covering apparatus is selected from the group comprising: a hood which at least partially covers and/or encloses the cleaning chamber; a casing which at least partially encloses the cleaning chamber; a door, in particular one or more sliding doors.

Embodiment 5: Cleaning apparatus according to one of the preceding embodiments, wherein the opening travel at least partially has a vertical direction component.

Embodiment 6: Cleaning apparatus according to one of the preceding embodiments, wherein the covering apparatus has different potential energy, in particular different positional energy, in the closed position and in the opened position.

Embodiment 7: Cleaning apparatus according to one of the preceding embodiments, wherein the covering apparatus, when in the opened position, is arranged at least partially above the closed position.

Embodiment 8: Cleaning apparatus according to one of the preceding embodiments, furthermore comprising at least one application apparatus for applying at least one cleaning fluid to the articles for cleaning in the cleaning chamber.

Embodiment 9: Cleaning apparatus according to the preceding embodiment, wherein the cleaning apparatus has at least one preparation tank which is formed separately from the cleaning chamber, in particular a boiler, wherein the temperature of a rinsing liquid can be controlled in the preparation tank while a washing process is taking place in the cleaning chamber.

Embodiment 10: Cleaning apparatus according to one of the preceding embodiments, wherein the force transmission path has at least one mechanism, wherein the torque converter is a constituent part of the mechanism.

Embodiment 11: Cleaning apparatus according to the preceding embodiment, wherein the mechanism comprises at least one traction means mechanism, in particular at least one chain mechanism.

Embodiment 12: Cleaning apparatus according to one of the preceding embodiments, wherein the force transmission path has at least one traction means, in particular a flexible traction means.

Embodiment 13: Cleaning apparatus according to the preceding embodiment, wherein the traction means is selected from the group comprising: a chain, in particular a roller chain, a bolt chain and/or a link chain; a cable and/or cable pull; an elastic band; a belt, in particular a toothed belt and/or a V-belt.

Embodiment 14: Cleaning apparatus according to one of the two preceding embodiments, wherein the traction means is of redundant configuration.

Embodiment 15: Cleaning apparatus according to one of the preceding embodiments, wherein the torque converter has at least one torque-transmitting element which is mounted so as to be rotatable about at least one axis, wherein at least one traction means engages on the torque-transmitting element at at least one engagement region or engagement point which is spaced apart from the axis by at least a spacing R, and said at least one traction means exerts a torque on the torque-transmitting element, wherein the spacing R is dependent on an angular position of the torque-transmitting element.

Embodiment 16: Cleaning apparatus according to the preceding embodiment, wherein the spacing R changes over at least one angle range.

Embodiment 17: Cleaning apparatus according to the preceding embodiment, wherein the change is selected from the group comprising: a continuous change; a steady change; a stepped change.

Embodiment 18: Cleaning apparatus according to one of the preceding embodiments, wherein the torque converter has at least one chain disc with variable radius.

Embodiment 19: Cleaning apparatus according to one of the preceding embodiments, wherein the covering apparatus is connected via at least one first traction means to a shaft, such that a rotational movement of the shaft can be converted into an opening or closing movement of the covering apparatus and/or such that an opening or closing movement of the covering apparatus can be converted into a rotational movement of the shaft.

Embodiment 20: Cleaning apparatus according to the preceding embodiment, wherein the shaft is connected via at least one further traction means to the spring element, wherein the at least one torque converter with the varying transmission ratio is arranged between the first traction means and the shaft and/or between the shaft and the further traction means.

Embodiment 21: Cleaning apparatus according to one of the preceding embodiments, wherein the spring element has different states of expansion in at least two different positions of the covering apparatus along the opening travel, wherein the torque converter is designed such that different spring forces of the spring element resulting from the different states of expansion are compensated by means of different transmission ratios, such that at least substantially identical forces act on the covering apparatus in the different positions.

Embodiment 22: Cleaning apparatus according to one of the preceding embodiments, wherein the spring element, the covering apparatus and the torque converter with its varying transmission ratio are configured such that, in the absence of action of additional forces, the covering apparatus remains at rest in any position of the opening travel.

Embodiment 23: Cleaning apparatus according to one of the preceding embodiments, wherein the spring element is of redundant configuration.

Embodiment 24: Cleaning apparatus according to one of the preceding embodiments, wherein the spring element has at least one safety element, wherein the safety element catches a breakage of the spring element.

Embodiment 25: Cleaning apparatus according to the preceding embodiment, wherein the safety element has at least one safety rod, wherein the force transmission path couples to the safety rod in the event of a breakage of the spring element.

Embodiment 26: Cleaning apparatus according to the preceding embodiment, wherein the coupling to the safety rod occurs as a result of jamming of a transmission element, in particular of a balance beam through which the safety rod extends.

Embodiment 27: Cleaning apparatus according to one of the preceding embodiments, wherein the covering apparatus furthermore has at least one actuation element, wherein the actuation element can be actuated by a user of the cleaning apparatus in order to exert a force on the covering apparatus and thereby move the covering apparatus from the closed position into the opened position or vice versa.

Embodiment 28: Cleaning apparatus according to the preceding embodiment, wherein the actuation element has at least one handle, wherein the handle engages, in particular directly, on the covering apparatus.

Embodiment 29: Cleaning apparatus according to one of the preceding embodiments, wherein the spring element is selected from the group comprising: a helical spring; a spiral spring; a torsion spring; a leaf spring; an elastic element, in particular an elastic band.

Embodiment 30: Cleaning apparatus according to one of the preceding embodiments, wherein the spring element is expanded to a maximum extent in the closed position of the covering apparatus.

Embodiment 31: Cleaning apparatus according to one of the preceding embodiments, wherein the cleaning apparatus furthermore has at least one electromechanical drive for moving the covering apparatus.

Embodiment 32: Cleaning apparatus according to the preceding embodiment, wherein the electromechanical drive has at least one motor.

Embodiment 33: Cleaning apparatus according to one of the two preceding embodiments, wherein the electromechanical drive is selectively couplable to the covering apparatus.

Embodiment 34: Cleaning apparatus according to one of the three preceding embodiments, wherein the electromechanical drive is couplable to the force transmission path.

Embodiment 35: Cleaning apparatus according to one of the four preceding embodiments, wherein the cleaning apparatus furthermore has at least one torque monitoring means for monitoring a torque exerted on the covering device by the electromechanical drive.

Embodiment 36: Cleaning apparatus according to the preceding embodiment, wherein the torque monitoring means is selected from the group comprising a torque support; a switch, in particular a torque switch and/or a limit switch; a torque sensor; a freewheel; a ratchet wheel.

Embodiment 37: Cleaning apparatus according to one of the preceding embodiments, wherein the cleaning apparatus furthermore has at least one controller, wherein the controller is configured to detect a movement and/or a position of the covering apparatus.

Embodiment 38: Cleaning apparatus according to the preceding embodiment, wherein the cleaning apparatus is furthermore configured to monitor forces and/or torques within the force transmission path.

Embodiment 39: Cleaning apparatus according to one of the preceding embodiments, wherein the cleaning apparatus has at least one guide element, wherein the guide element is configured to guide the covering apparatus over the opening travel.

Embodiment 40: Cleaning apparatus according to the preceding embodiment, wherein the guide element has at least one guide rail.

Embodiment 41: Cleaning apparatus according to one of the two preceding embodiments, wherein the guide element is arranged outside the cleaning chamber.

Embodiment 42: Method for cleaning articles for cleaning, in particular using a cleaning apparatus according to one of the preceding embodiments, comprising cleaning the articles for cleaning in at least one cleaning chamber, wherein at least one covering apparatus which at least partially encloses the cleaning chamber is used, wherein the method furthermore comprises moving the covering apparatus over an opening travel from a closed position into an opened position or vice versa, wherein the covering apparatus is connected via at least one force transmission path to at least one spring element, wherein at least one spring force of the spring element is transmitted by means of the force transmission path to the covering apparatus, wherein the force transmission path has at least one torque converter, wherein the torque converter has a transmission ratio which varies over the opening travel.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
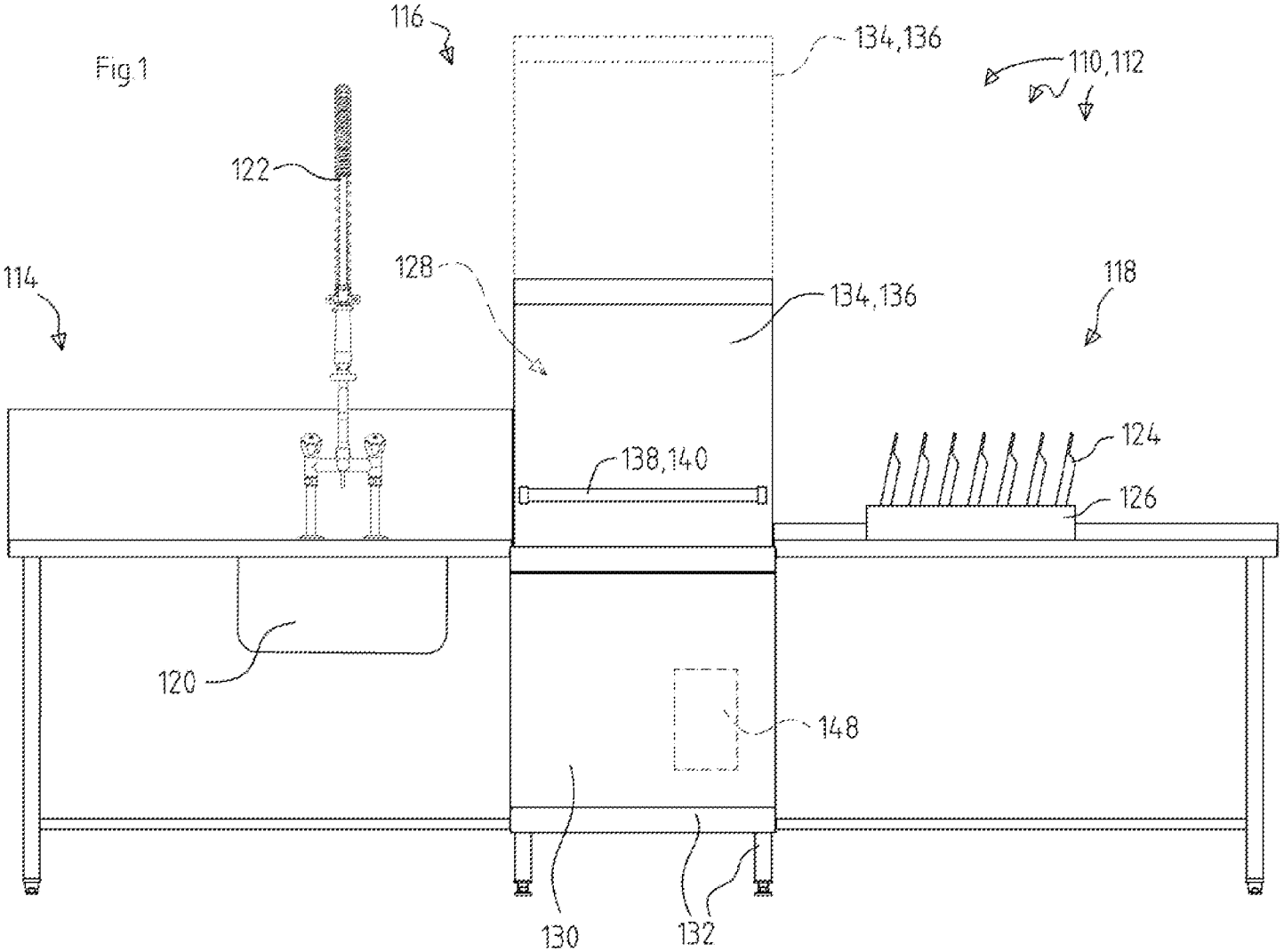
FIG. 1 shows an exemplary front view of a pass-through dishwasher and of a hood-type dishwasher in which this disclosure can be implemented.
Figure 2:
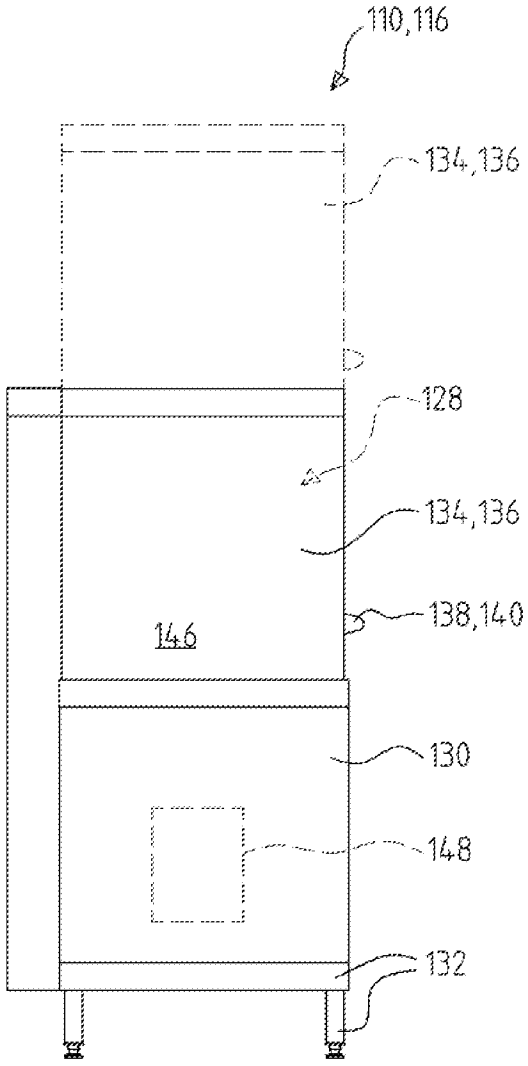
FIG. 2 shows a side view of the hood-type dishwasher as per FIG. 1.

FIG. 1 illustrates an exemplary embodiment of a cleaning apparatus 110 according to this disclosure. The cleaning apparatus 110 is, in this exemplary embodiment, configured as a pass-through dishwasher 112, which has an inlet table or feed table 114, a hood-type dishwasher 116 and an outlet table 118. The cleaning apparatus 110 is illustrated in a front view in FIG. 1. FIG. 2 shows the hood-type dishwasher 116 once again in a side view.

In addition to the hood-type dishwasher 116, the pass-through dishwasher 112 comprises, by way of example, in the region of the feed table 114, a basin 120 and a shower hose 122 for pre-cleaning of the articles for cleaning 124, which may for example be crockery or other types of articles for cleaning as mentioned above. Said articles for cleaning may be introduced for example by means of one or more crockery baskets 126 into a cleaning chamber 128 of the cleaning apparatus 110. There, one or more cleaning fluids may be applied to the articles for cleaning 124, for example by means of one or more application apparatuses, for example nozzle systems, which are not illustrated in any more detail in FIGS. 1 and 2.

The hood-type dishwasher 116 has a base 130 which has, for example, a frame 132. Furthermore, the hood-type dishwasher 116 comprises a covering apparatus 134 which, in this exemplary embodiment, is designed by way of example as a hood 136. Said hood 136 can be opened over an opening travel or travel path and, in FIGS. 1 and 2, is illustrated in each case by solid lines in a closed position and by dashed lines in an opened position. The hood-type dishwasher 116 furthermore has at least one actuation element 138 in the form of a handle 140. In FIG. 2, analogously to the illustration of the hood 136, the handle 140 is illustrated by solid lines in the closed position and by dashed lines in the opened position. The handle 140 engages, for example, directly on the hood 136.

In the base 130 of the hood-type dishwasher 116 there may furthermore be arranged at least one controller 148. Furthermore, further elements may be arranged in the base 130, such as for example at least one preparation tank, for example at least one boiler, in which the temperature of a rinsing liquid can be controlled. Said elements are not illustrated in the figures.

Figure 3:
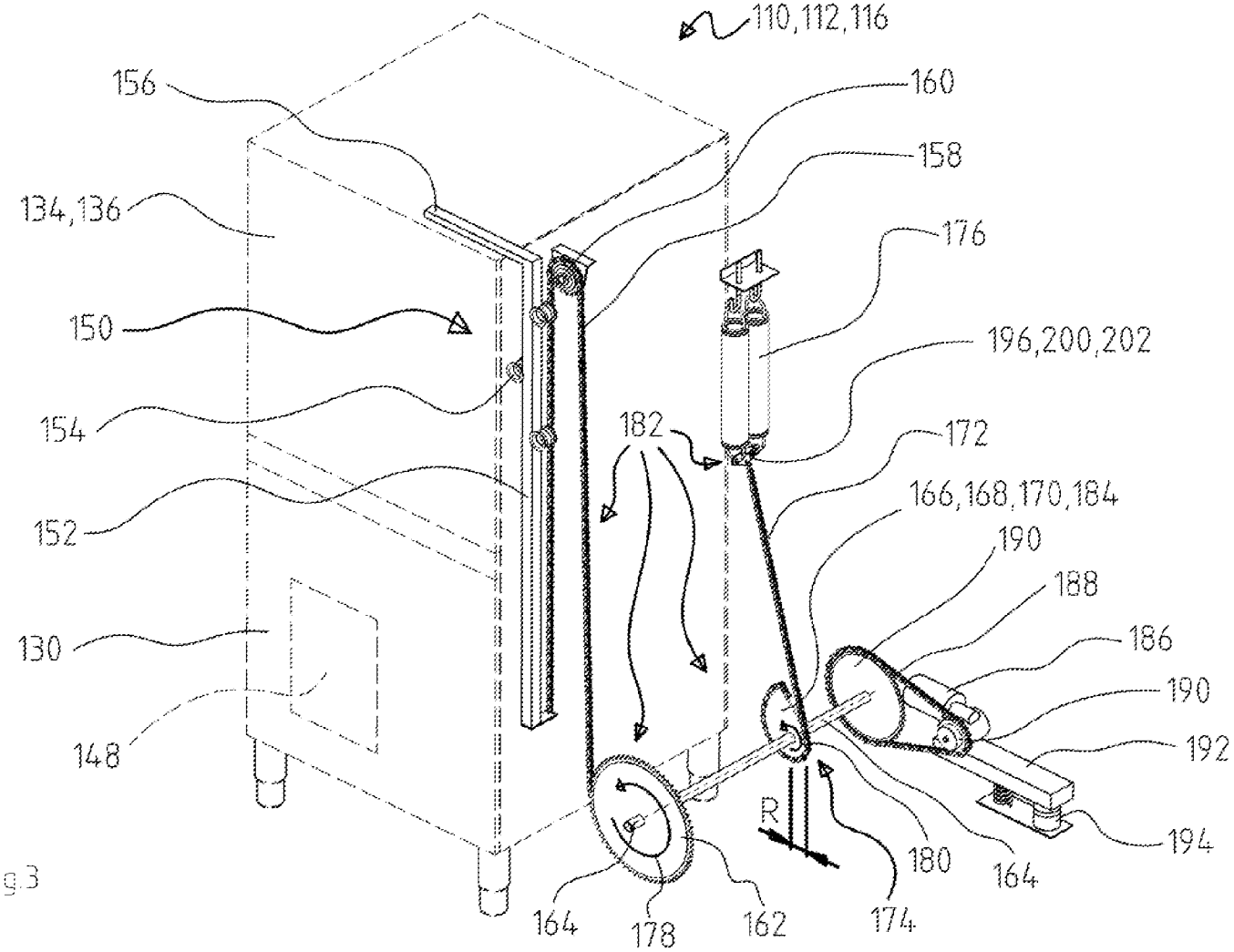
FIG. 3 shows a schematic view of a force transmission path and of spring elements for weight compensation for the hood of the hood-type dishwasher.

The cleaning apparatus 110 has guides or guide elements 150 at both sides on its rear side, wherein one of said guide elements 150 is schematically illustrated in FIG. 3. Said guide element 150 may, as illustrated in FIG. 3, have for example a guide rail 152 or some other type of guide profile, for example a rectangular profile in the form of a rectangular tube and/or square tube. This is arranged vertically, as shown in FIG. 3. Each guide element 150 is supported for example by means of rollers 154, for example three rollers on each side. On the guide elements 150, in each case one cantilever arm 156 is formed in a forward direction at the top, onto which cantilever arm the for example fully preassembled hood 136 can be pushed and secured using only a small number of fastening elements, for example two bolts.

A first traction means or traction member 158, for example at least one first roller chain, is fastened to each guide element 150 at the bottom. Said first traction means 158 is guided in each case over a diverting wheel 160 in the upper region of a housing of the cleaning apparatus 110. The first traction means 158 is furthermore laid onto in each case one first sprocket 162 in the lower region of the housing. The illustrated arrangement of the guide element 150, of the first traction means 158, of the diverting wheel 160 and of the first sprocket 162 is duplicated on the opposite side of the rear side of the cleaning apparatus 110, such that two, for example identical, first sprockets 162 are provided, of which, in order to simplify the illustration, only one is illustrated in FIG. 3. The two first sprockets 162 are connected rotationally conjointly to one another by means of a shaft 164 on which they are mounted rotationally conjointly. Furthermore, a torque converter 166 is mounted, likewise rotationally conjointly, on said shaft 164. Said torque converter comprises a rotatably mounted torque-transmitting element 168, which in this exemplary embodiment is in the form of a third sprocket 170. Said third sprocket 170 is mounted so as to be rotatable about the axis of the shaft 164. Furthermore, a third traction means (also referred to as traction member) 172 is laid onto said third sprocket 170, which third traction means lifts off from the third sprocket 170 at an engagement point 174 and is connected at its other end to, by way of example in this exemplary embodiment, two spring elements 176. The hood 136 is illustrated in the closed position in FIG. 3. During a movement along an opening travel path, the guide element 150 moves upward, and the first sprockets 162 rotate in a direction of rotation 178. During this opening movement, the third sprocket 170 rotates in a direction of rotation 180 which is for example identical to the direction of rotation 178.

The torque-transmitting element 168 in the form of the third sprocket 170 is in this case designed with a non-uniform radius, as can be seen in FIG. 3. This means that a spacing R between the engagement point 174 and the axis changes with an angular position of the torque-transmitting element 168. Thus, however, the torque transmitted by the third traction means 172 to the shaft 164 also changes, because said torque is dependent on the angular position of the sprocket 170.

When the hood 136 is closed, the two chains of the first traction means 158, which are fastened to the guide rails 152 at the bottom, have been substantially unwound from the sprockets 162. By contrast, the third traction means 172, which is likewise in the form of a roller chain, for example, has been substantially wound up on its third sprocket 170, and the spring elements 176, which are for example in the form of tension springs, are in a stressed state, as shown in FIG. 3. When the hood 136 is lifted, the two first traction means 158 wind up on their wheels 162. At the same time, the third traction means 172 is unwound, and the spring elements 176 are relieved of stress.

To compensate the change in the spring force of the spring elements 176 over the opening travel, the third sprocket 170, as stated above, exhibits an effective radius and/or a pitch circle which varies over the circumference. By means of this design, the variation of the spring force over the opening travel or versus the expansion can be adapted to the force actually required for the compensation of the weight of the hood 136. In addition to a uniform and/or continuous decrease in radius or increase in radius, it is also possible to realize non-uniform adaptations of the effective radius R. It is thus possible, for example, for step changes in diameter to be incorporated on the sprockets for the purposes of damping a movement at the end positions.

The traction means 158 and the torque converter 166 are constituent parts of a force transmission path 182 by means of which a spring force of the at least one spring element 176 can be transmitted to the covering apparatus 134 in converted form. Further constituent parts of the force transmission path may be the diverting wheels 160 and the first sprockets 162 and the shaft 164. Owing to the effective radius R which varies with respect to the angular position, the torque converter 166 and thus the force transmission path 182 as a whole have a transmission ratio which varies over the opening travel. The torque converter 166 is thus for example a constituent part of a mechanism 184 which has a variable transmission ratio which varies over the opening travel of the hood 136.

The sprockets 162, 170 may for example be manufactured from metal individually and assembled. Furthermore, individual parts of the wheel set, such as for example guide discs, may also be manufactured entirely or partially from plastic. It is also conceivable for the entire wheel set to be manufactured from plastic. The wheel set is preferably mounted with rolling bearings, which promotes lower friction and thus smooth running. The sprockets 162 and the shaft 164 and also the traction means 158, 172 may be further constituent parts of the mechanism 184.

To be able to realize a machine design with a semiautomatic and/or fully automatic hood 136, it is optionally possible for at least one electromechanical drive 186, for example at least one electric motor, to be coupled to the wheel set, to the force transmission path 182 or else to the mechanism 184. Said electromechanical drive may be coupled on for example by means of a further chain 188 and/or some other type of traction means and by means of two pinions 190, which may be of identical or else different design, and/or by means of a further mechanism with a fixed or variable transmission ratio.

To protect the operating personnel from excessively high closing forces of the semiautomatic or fully automatic hood, multiple solutions may be implemented in the case of an optional semiautomatic or else fully automatic hood. For example, the electric motor may for example be fastened such that its torque is absorbed by a spring-supported torque support 192. In the presence of an excessively high torque, for example an excessively high closing force on the hood 136, said torque support 192 is deflected. Said movement may be detected for example by means of a switch 194, which can transmit its signal to the controller 148. The controller 148 may then for example end the movement of the hood 136 and optionally initiate a reversed movement.

Alternatively or in addition, at least one rotary encoder may be integrated in the force transmission path 182 including the electromechanical drive 186, which at least one rotary encoder may likewise be connected to the controller 148. Said rotary encoder is not illustrated in FIG. 3. The controller 148 can for example identify an absence of the signals from the rotary encoder, for example because a movement is impeded. In this case, the controller 148 can then for example end the movement of the hood and/or initiate a reversed movement. To limit a pinching force that may arise, the weight compensation force for the hood 136 may be coordinated with the closing force by the drive such that safe values are not exceeded.

Various configurations are possible for the weight compensation. Examples include:

For manual hood actuation: the weight of the hood 136 may be 100% compensated over almost the entire movement travel. It may for example be provided that the weight is not fully compensated only in the lower end position, that is to say in the closed position, such that the hood 136 remains securely closed during operation.

For semiautomatic hood actuation: the weight compensation may be set, over the entire opening travel or movement travel, such that the hood automatically moves into the open position. For the operation of the cleaning apparatus 110, the operating personnel can move the hood 136 into the lower, closed position by hand. There, the hood is for example automatically fixed and/or locked, for example by means of a separate mechanism which can be actuated by the controller 148. At the end of a cleaning cycle, the machine controller 148 can unlock the hood 136, and the latter can open.

For fully automatic hood actuation: the weight of the hood 136 may be 100% compensated over the entire movement travel. A drive mechanism can move the hood in accordance with commands from the machine controller 148.

To increase safety for the operating personnel in the event of failure of individual components for the weight compensation, it is for example possible for multiple elements of the force transmission path 182 to be of redundant configuration. For example, instead of a single third traction means 172, for example a single third chain, use may be made of two chains in parallel or "back-to-back." Furthermore, the third traction means 172 may alternatively or additionally be supplemented by a further deformable component and/or traction means, for example a cable, which can absorb the tensile force in the event of breakage of the chain.

Figure 4:
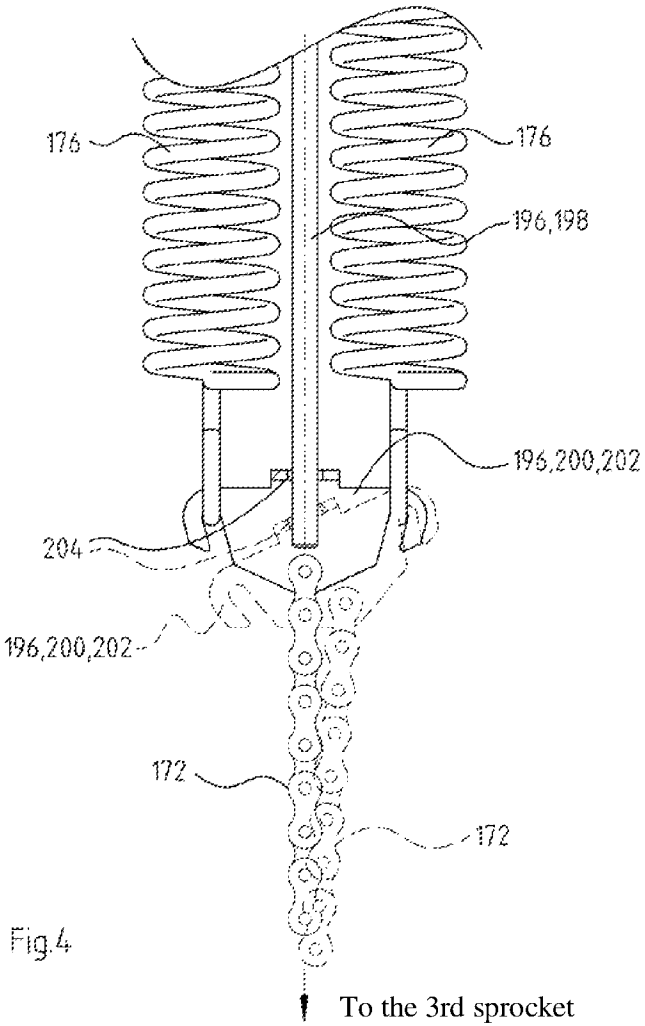
FIG. 4 shows an example of a safety element for safety in the event of a breakage of a spring element in the embodiment as per FIG. 3.

Further possible refinements relate to safety elements which offer safety in the event of a breakage of the at least one spring element 176. For example, the spring element 176 may have at least one safety element 196 which may for example be a direct constituent part of the spring elements 176 or which may also be coupled thereto, a situation which is likewise intended to be encompassed. For example, said safety element 196 may comprise a catching element or a catching device which, in this exemplary embodiment, are coupled for example to both spring elements 176. For example, said safety element may have at least one safety rod 198, wherein the force transmission path 182 can couple to the safety rod 198 in the event of a breakage of the at least one spring element 176, or in the case of multiple spring elements 176. As can be seen in particular in FIG. 4, said coupling-on may be realized by means of at least one transmission element 200. Said transmission element 200 may be designed in particular as a balance beam 202, as shown by way of example in FIG. 4. Said balance beam is, at its outer ends, connected symmetrically to the two spring elements 176 and has, in the center, a bore 204 through which the safety rod 198 which acts as a catching rod is guided. At a lower end, the third traction means 172 is coupled to the balance beam 202.

During normal operation, the balance beam 202 slides freely on the safety rod 198, and the lower suspension point of the third traction means 172 moves with an expansion of the spring elements 176. If one spring element 176 breaks, then there is no longer a symmetrical introduction of force onto the balance beam 202. The balance beam 202 tilts on the safety rod 198 and thereby becomes jammed and immobilized. An uncontrolled fall of the hood 136 is thus prevented.

As stated above, it is possible in particular for two first traction means 158 to be provided. Some other number is however also possible. Furthermore, two or more of the stated elements may also be entirely or partially combined. For example, the two first traction means 158 may also be of shorter form and connected for example to a single chain, which may then be connected individually by means of the wheel set to the weight compensation spring elements 176.

Instead of the stated roller chains, this disclosure may also be realized with other flexible or deformable traction means or in combination with different types of traction means. For example, use may be made of bolt chains, link chains, belts or cables.

Altogether, a very smooth movement of the covering apparatus or of the hood on the described cleaning apparatus can be realized, because very smooth running of the mechanism as a whole can be ensured even over long operating periods. Furthermore, very quiet operation can be realized. By means of permanent lubrication of the moving parts, the cleaning apparatus 110 can furthermore be realized so as to require little maintenance or even no maintenance.

By means of the easy installation as described above, it is possible in particular for the hood 136 to be installed easily and quickly. Furthermore, very large opening travels, in particular very large lifting heights, of the hood 136 can be realized. In this way, even large pass-through heights can be realized in the illustrated pass-through dishwasher 112.

The illustrated cleaning apparatus is furthermore highly variable with regard to the adaptation of an effective compensation force on the hood 136. All that is required for this purpose is a corresponding adaptation of the radii or effective radii R on the torque-transmitting element 168.

Furthermore, as presented above, safety measures for safety in the event of failure of individual components can be realized to a high degree.

Furthermore, the cleaning apparatus is altogether highly flexible with regard to the actuation. For example, a variation from a manually actuated hood 136 to an automatic or semiautomatic hood 136 is easily possible. In this way, it is in particular also possible to realize a modular construction. Furthermore, good adjustment possibilities also exist for automatic hood systems.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE DESIGNATIONS

| | |
|---|---|
| 110 | Cleaning apparatus |
| 112 | Pass-through dishwasher |
| 114 | Feed table |
| 116 | Hood-type dishwasher |
| 118 | Outlet table |
| 120 | Basin |
| 122 | Shower hose |
| 124 | Articles for cleaning |
| 126 | Crockery basket |
| 128 | Cleaning chamber |
| 130 | Base |
| 132 | Frame |
| 134 | Covering apparatus |
| 136 | Hood |
| 138 | Actuation element |
| 140 | Handle |
| 146 | Side wall |
| 148 | Controller |
| 150 | Guide element |
| 152 | Guide rail |
| 154 | Roller |
| 156 | Cantilever arm |
| 158 | First traction means |
| 160 | Diverting wheel |
| 162 | First sprocket |
| 164 | Shaft |
| 166 | Torque converter |
| 168 | Torque-transmitting element |
| 170 | Third sprocket |
| 172 | Third traction means |
| 174 | Engagement point |
| 176 | Spring element |
| 178 | First direction of rotation |
| 180 | Second direction of rotation |
| 182 | Force transmission path |
| 184 | Mechanism |
| 186 | Electromechanical drive |
| 188 | Chain |
| 190 | Pinion |
| 192 | Torque support |
| 194 | Switch |
| 196 | Safety element |
| 198 | Safety rod |
| 200 | Transmission element |
| 202 | Balance beam |
| 204 | Bore |

What is claimed is:

1. A hood-type or pass-through dishwasher, comprising:

a cleaning chamber and a cover configured to at least partially enclose the cleaning chamber, the cover comprising (i) a hood which at least partially covers and/or encloses the cleaning chamber, (ii) a casing which at least partially encloses the cleaning chamber, or (iii) a door;

the cover being movable over an opening travel path from a closed position to an opened position or vice versa, wherein the cover is connected via a force transmission path to at least one spring element, wherein a spring force of the spring element can be transmitted by the force transmission path to the cover;

the force transmission path comprising a torque converter having a transmission ratio which varies over the opening travel path; and a traction drive positioned along the force transmission path, the torque converter being a constituent part of the traction drive.

2. The dishwasher of claim 1, wherein the force transmission path has a traction member.

3. The dishwasher of claim 2, wherein the traction member is a chain, cable, cable pull, elastic band or a belt.

4. The dishwasher of claim 3, wherein the traction member is a chain and the chain comprises a roller chain, a bolt chain or a link chain.

5. The dishwasher of claim 3, wherein the traction member is a belt and the belt comprises a toothed belt or a V-belt.

6. The dishwasher of claim 1, wherein:

the torque converter has a torque-transmitting member rotatably mounted about an axis;

a traction member engages the torque-transmitting member at an engagement region which is spaced apart from the axis by a spacing R;

the traction member exerts a torque on the torque-transmitting member; and the spacing R changes as a function of an angular position of the torque-transmitting member.

7. The dishwasher of claim 6, wherein the spacing R changes over an angle range, the change being a continuous change, a steady change, or a stepped change.

8. The dishwasher of claim 1, wherein the torque converter has a chain disc with a variable radius.

9. The dishwasher of claim 1, wherein cover is connected via a first traction member to a shaft, whereby a rotational movement of the shaft can be converted into an opening or closing movement of the cover.

10. The dishwasher of claim 9, wherein the shaft is connected via a second traction member to the spring element, wherein the torque converter is arranged between the first traction member and the shaft and/or between the shaft and the second traction member.

11. The dishwasher of claim 1, wherein the spring element has different states of expansion in at least two different positions of the cover along the opening travel path, wherein the torque converter is configured such that different spring forces of the spring element resulting from the different states of expansion are compensated by different transmission ratios, whereby substantially identical forces act on the cover in the different positions.

12. The dishwasher of claim 1, wherein the spring element, the covering and the torque converter are configured such that, in the absence of action of additional forces, the cover remains at rest in any position of the opening travel path.

13. The dishwasher of claim 1, wherein the spring element has a safety element that is configured to catch a break of the spring element.

14. The dishwasher of claim 1, further comprising an electromechanical drive configured for moving the cover.

15. The dishwasher of claim 14, further comprising a torque monitor configured to monitor torque exerted on the cover by the electromechanical drive.

16. A method of using the dishwasher of claim 1, the method comprising moving the cover over the opening travel path from a closed position into an opened position or vice versa and transmitting a spring force of the spring element via a force transmission path to the cover.

* * * * *